US005556256A

United States Patent [19]

Shao

[11] Patent Number: 5,556,256

[45] Date of Patent: Sep. 17, 1996

[54] SWIVEL MECHANISM FOR AN ELECTRICAL FAN

[76] Inventor: Steve Shao, 6 Surro Dr., Framingham, Mass. 01701

[21] Appl. No.: 410,768

[22] Filed: Mar. 27, 1995

Related U.S. Application Data

[63] Continuation-in-part of Ser. No. 281,041, Jul. 27, 1994, Pat. No. 5,458,462.

[51] Int. Cl.[6] ..... F04D 29/36

[52] U.S. Cl. ..... 416/100; 416/244 R; 416/247 R; 403/141; 403/142; 403/143

[58] Field of Search ..... 416/100, 102, 416/108, 110, 170 R, 244 R, 247 R, 98; 74/47; 403/141, 142, 143

[56] References Cited

U.S. PATENT DOCUMENTS

| | | | |
|---|---|---|---|
| 2,313,481 | 3/1943 | Rendano | 416/100 |
| 2,652,974 | 9/1953 | Fettel . | |
| 4,568,216 | 2/1986 | Mizusawa et al. | 403/141 |
| 4,626,123 | 12/1986 | Brown | 403/141 |
| 5,310,313 | 5/1994 | Chen . | |
| 5,393,161 | 2/1995 | Mata et al. | 403/141 |

FOREIGN PATENT DOCUMENTS

| | | | |
|---|---|---|---|
| 60-81496 | of 1985 | Japan . | |
| 203475 | 9/1923 | United Kingdom . | |
| 0241938 | 4/1926 | United Kingdom | 403/143 |
| 301576 | 12/1928 | United Kingdom . | |

OTHER PUBLICATIONS

National Human Electronics catalog, p. 11, '92–4.

*Primary Examiner*—Edward K. Look
*Assistant Examiner*—Christopher Verdier

[57] ABSTRACT

An electrical fan having a positioning mechanism, driven by the rotation of the fan's motor, which causes the fan's head to simultaneously pivot sinusoidally and continuously about a pair of perpendicular axes to continuously redirect the airstream from the fan in a conical pattern.

20 Claims, 16 Drawing Sheets

SWIVEL MECHANISM FOR AN ELECTRICAL FAN

This application is a Continuation-In-Part of application Ser. No. 08/281,041, filed Jul. 27, 1994, now U.S. Pat. No. 5,458,462 the specification of which is incorporated herein by reference.

FIELD OF THE INVENTION

This invention relates generally to motorized appliances wherein it is desirable to move one portion of the appliance relative to another in a conical pattern, and specifically to electrical fans which employ a fan head positioning mechanism for continuous redirection of the airstream from the fan.

BACKGROUND OF THE INVENTION

The benefits of continuously redirecting the airflow of an electrical fan are well known. Numerous fans intended to cool persons have been equipped with redirection mechanisms over the years since electrical fans were initially developed.

Rectangular fans, generically known as "box" fans, have often been equipped with rotating circular front grills which include airstream deflectors that are pitched from the fan's general direction. As air leaves the fan blade within the fan, it travels forward until it reaches the front grill deflectors and is thereby redirected at some angle. As the front grill rotates, the redirection angle is changed such that the airstream follows a basically conical shape. Rotation of the front grill is accomplished most often by direct coupling to an independent low-speed motor. Alternately, the front grill is often rotationally uncoupled and driven by the forces of the airstream. In the former case, the independent motor adds expense to the manufacture and use of the fan. In the later case, the energy taken from the airstream to rotate the grill reduces the total energy of the airstream, resulting in a slower airstream velocity and shorter downstream air penetration. In either case, the airflow pattern from the fan describes only a circular pattern, in accordance with the circular rotation of the grill.

Another class of fans, generically known as "oscillating" fans, employ various mechanisms to continuously change the airstream's general direction. Both the motor and blade of the fan are continually repositioned by the mechanisms. Some of these employ independent low speed motors to cyclically swivel the fan back and forth in a particular pattern. Some derive their oscillating energy from the airstream. In either case, the drawbacks previously mentioned apply.

A very common oscillating fan design is depicted in FIGS. 1 through 2(*c*) and employs an output shaft (M4) extending from both the front and the back of the motor (M). At the downstream end (M5) of the shaft is attached the fan blade (F1). The upstream end of the shaft includes a worm gear (not shown). A reducing gearbox (B) is coupled to the worm gear and includes a low-speed output shaft (B1), positioned perpendicularly to the fan's output shaft, and pivotably connected to mechanical ground (B4) by and a planar hinged link member (B2/B3). The fan head (H), including the motor and blade, are free to pivot relative to mechanical ground about a single axis (M2) which is perpendicular to the fan's output shaft and to the gearbox's output shaft. Rotation of the fan's output shaft causes rotation of the low speed shaft which in turn, by opening and closing of the hinged link, causes planar pivoting of the fan head back and forth about the single axis. FIGS. 2(*a*), 2(*b*), and 2(*c*), are partial top views showing the configurations of the hinged link member while the fan head (not shown) is directed in various positions.

In FIG. 2(*a*), with low-speed output shaft (B1), and therefore also hinged link member portion (B2), positioned clockwise ninety angular degrees from single axis (M2), as shown in solid line representation, the fan head is directed forwardly. In the phantom line representation of FIG. 2(*a*), with low-speed output shaft (B1), and therefore also hinged link member portion (B2), positioned zero angular degrees from single axis (M2), the fan head is directed rightward.

In FIG. 2(*b*), with low-speed output shaft (B1), and therefore also hinged link member portion (B2), positioned counter-clockwise ninety angular degrees from single axis (M2), as shown in solid line representation, the fan head is directed leftward. In the phantom line representation of FIG. 2(*b*), with low-speed output shaft (B1), and therefore also hinged link member portion (B2), positioned one hundred eighty angular degrees from mechanical ground connection (B4), the fan head is directed farther leftward. This condition represents the farthest leftward direction obtained by this system.

In FIG. 2(*c*), with low-speed output shaft (B1), and therefore also hinged link member portion (B2), positioned clockwise approximately one hundred fifty angular degrees from single axis (M2), as shown in solid line representation, the fan head is directed leftward. In the phantom line representation of FIG. 2(*c*), with low-speed output shaft (B1), and therefore also hinged link member portion (B2), positioned clockwise ninety angular degrees from single axis (M2), as in the solid line representation of FIG. 2(*a*), the fan head is directed forward.

Although the oscillation mechanism of the prior art depicted in FIGS. 1 through 2(*c*) has proven reliable, economical, and more effective in broadcasting the airstream over a wider area than non-oscillating fans, it suffers from it's inability to direct the airstream from the plane on which it pivots.

Some fans of the prior art employ the basic concept of the previous design, but instead include a low speed gearbox output shaft which extends parallel with the fan's output shaft. This low speed shaft is rotatably linked by a single rigid link member to mechanical ground. The fan head is free to pivot relative to mechanical ground about two axes which are perpendicular to each other and to the fan's output shaft. Rotation of the fan's output shaft causes rotation of the low speed shaft which in turn causes gyration of the fan about the two axes in a circo-conical pattern. Although this mechanism has also proven reliable, economical, and more effective in broadcasting the airstream over a wider area than non-oscillating fans, it suffers from it's inability to direct the airstream from said circo-conical pattern.

Prior fans have been known which employ mechanisms that convert rotation of the fan motor into continuous circo-conical redirection of the airstream. However, these fans do not employ means to manage the abnormal forces encountered as a result of the vertical movement of the fan head with and against gravity. Nor do these fans employ means to avoid looseness within the mechanism as the mechanism wears because of these abnormal conditions.

SUMMARY OF THE INVENTION

It is the object of the present invention to provide an electrical fan with a fan head positioning system which uses the rotation of the fan's output shaft to continuously change the airstream's general direction in a pattern which is either planar, circo-conical, or ellipto-conical. Accordingly, the redirecting pattern of the airstream from the fan may be customized by either the manufacturer or the end-user to serve areas of various sizes and shapes.

It is a further object of the present invention to provide such a fan which overcomes the adverse effects of gravity on the redirection motion.

It is a further object to provide such a fan which maintains a smooth and consistent redirection movement even as the mechanism's moving components become worn.

BRIEF DESCRIPTION OF THE DRAWINGS

Features of the prior art and objects, features, and advantages of the present invention will be more clearly understood by those skilled in the art from the following drawings in which:

FIG. 5(A2) is a top view of the positioning mechanism of FIG. 5(A1);

FIG. 5(B1) is a partial side view of the positioning mechanism of FIG. 3, but in a configuration so as to direct the fan head downward and forward;

FIG. 5(B2) is a top view of the positioning mechanism of FIG. 5(B1), but having some components positioned normal to view for clarity;

FIG. 5(B3) is a cross-sectional view through the ball & socket connection of the positioning mechanism of FIG. 5(B1), taken at plane B—B of FIG. 5(B2);

DESCRIPTION OF PREFERRED EMBODIMENTS OF THE INVENTION

Figure 1:
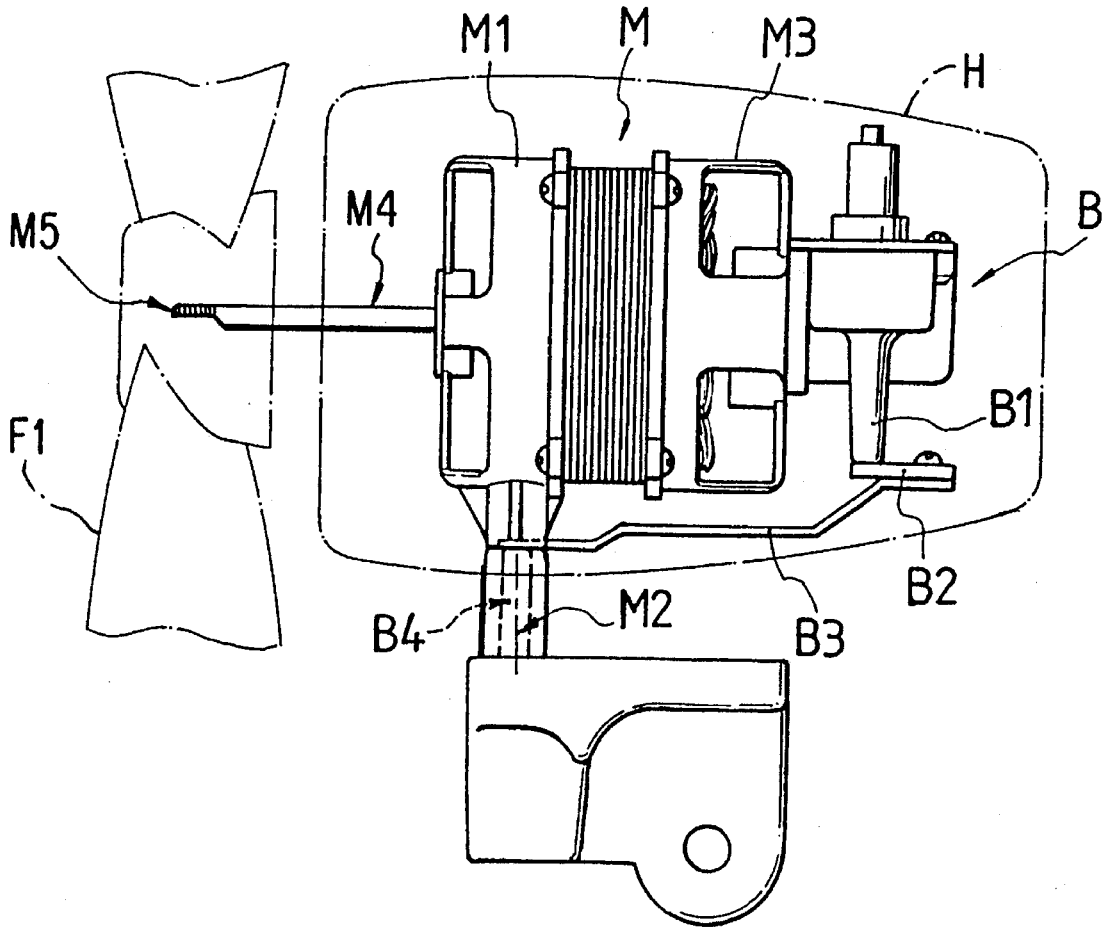
FIG. 1 (PRIOR ART)
FIG. 1 is a partial side view of the prior art fan previously described, depicting the motor and oscillation mechanism.
Figure 2A:
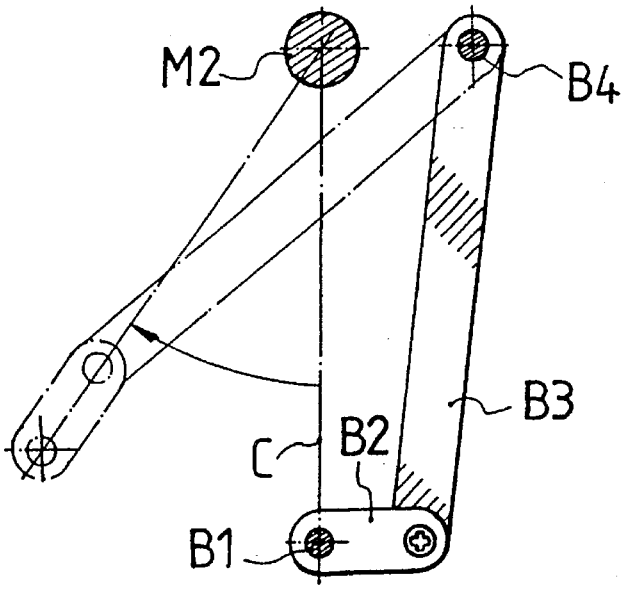
FIG. 2(A) (PRIOR ART)
FIGS. 2(*a*), 2(*b*), and 2(*c*) are partial top views of the oscillation mechanism of the prior art fan of FIG. 1 depicting various configurations of the hinged link member as previously described.
Figure 2B:
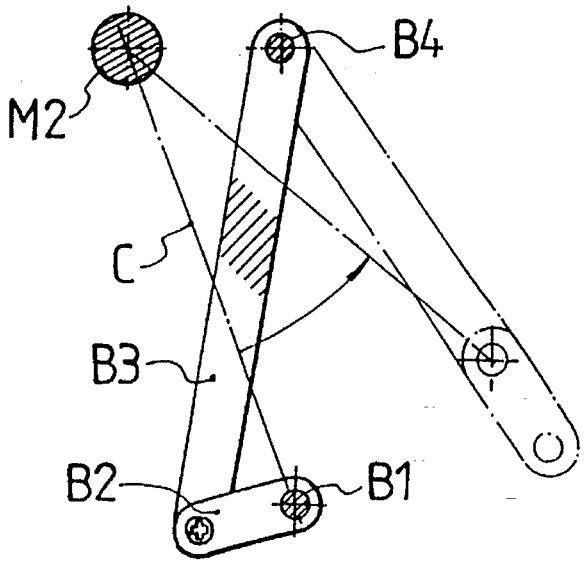
FIG. 2(B) (PRIOR ART)
Figure 2C:
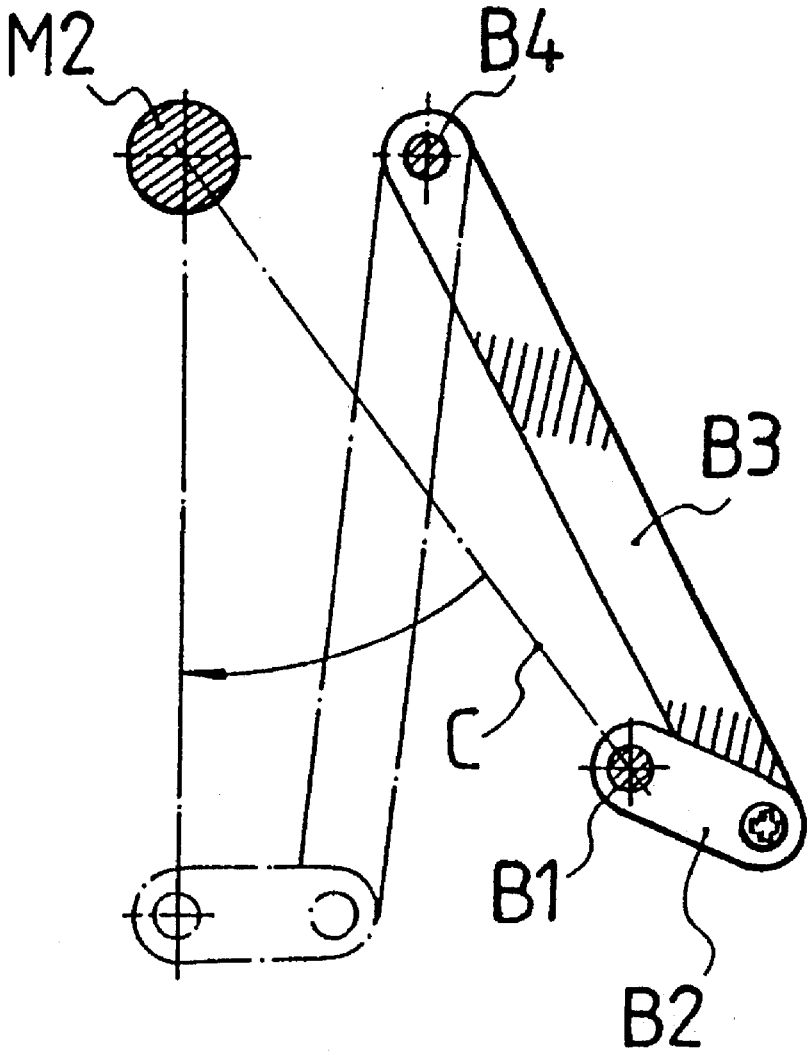
FIG. 2(C) (PRIOR ART)

A preferred embodiment of the invention is depicted in FIGS. 3 through 8, to which reference is made throughout the following description.

In the depicted embodiment, fan motor (M) is supported by yoke (1) at horizontally coaxial pivot pins (11). The head is free to pivot up-down about the horizontal axis of the pins. Tangential biasing springs (5), surrounding both horizontally coaxial pivot pins, act around the axis of the pins and between the yoke and the motor, forcing downward on the lighter rear (upstream) end of the motor, counter to the gravitational forces which bias the heavier forward (upstream) end of the motor downward. The bias springs thereby serve to bias the fan head (F) in a horizontally neutral position and reduce the stress on the positioning system as it alters the fan head's up and down position. Downward motion of the fan head is limited by the positioning mechanism such that the fan head cannot tilt downward far enough to disengage the bias springs from the yoke and motor. The yoke is supported by and pivotably engages vertical pin (2), The yoke and the fan head are free to pivot side to side about the vertical axis of the vertical pin. The vertical pin is fixed within fan head support (S), and restrained from rotation relative thereto.

The fan motor includes fan motor shaft (M4), which engages and drives fan blade (F1) at the downstream end, and which engages and drives reducing gears (not shown) at the upstream end within gear box (B). The low-speed output shaft (B1) of the gearbox rotates at a rotational speed slower than the fan motor rotational speed. The gearbox shaft is fixedly connected to rotating link (3), which in turn is connected eccentrically to swinging link (4) by ball & socket connection (31). Alternately, the swinging link is hingedly connected to the vertical pin at horizontal swing pin (22) so as to allow unidirectional pivoting between the swinging link and the vertical pin and limit the motion of the swinging link to up and down. Because the distance between the ball & socket connection and the vertical pin is fixed by the rigidity of the swinging link, and because the rotational position of the ball & socket connection about the vertical pin axis is fixed by the unidirectional pivoting of the swinging link, rotation of the rotating link through rotation of the fan motor shaft forces two simultaneous changes in the relationship between the gearbox shaft axis and the vertical pin. The distance between the two is sinusoidally increased and decreased while the rotational position of the gearbox axis about the vertical pin axis is sinusoidally altered. The sinusoidal altering of the rotational position of the gear box axis about the vertical pin axis causes the fan head, relative to which the gearbox axis is fixedly positioned, to pivot side to side about the pivotable engagement of the yoke and vertical pin. The sinusoidal increase and decrease in the distance between the gearbox shaft axis and the vertical pin causes the fan head to pivot up and down about the horizontal coaxial pivot pins of the yoke. The simultaneous side-to-side and up-down oscillations result in the fan head direction changing continuously as it describes a conical shape.

The described arrangement could be constructed as depicted, or alternatively having more than two pivot axes, having the socket of the ball and socket connection comprised in the swinging link and the ball comprised in the rotating link, or having the horizontal swing pin instead arranged vertically and the gearbox axis arranged horizontally.

Figure 3:
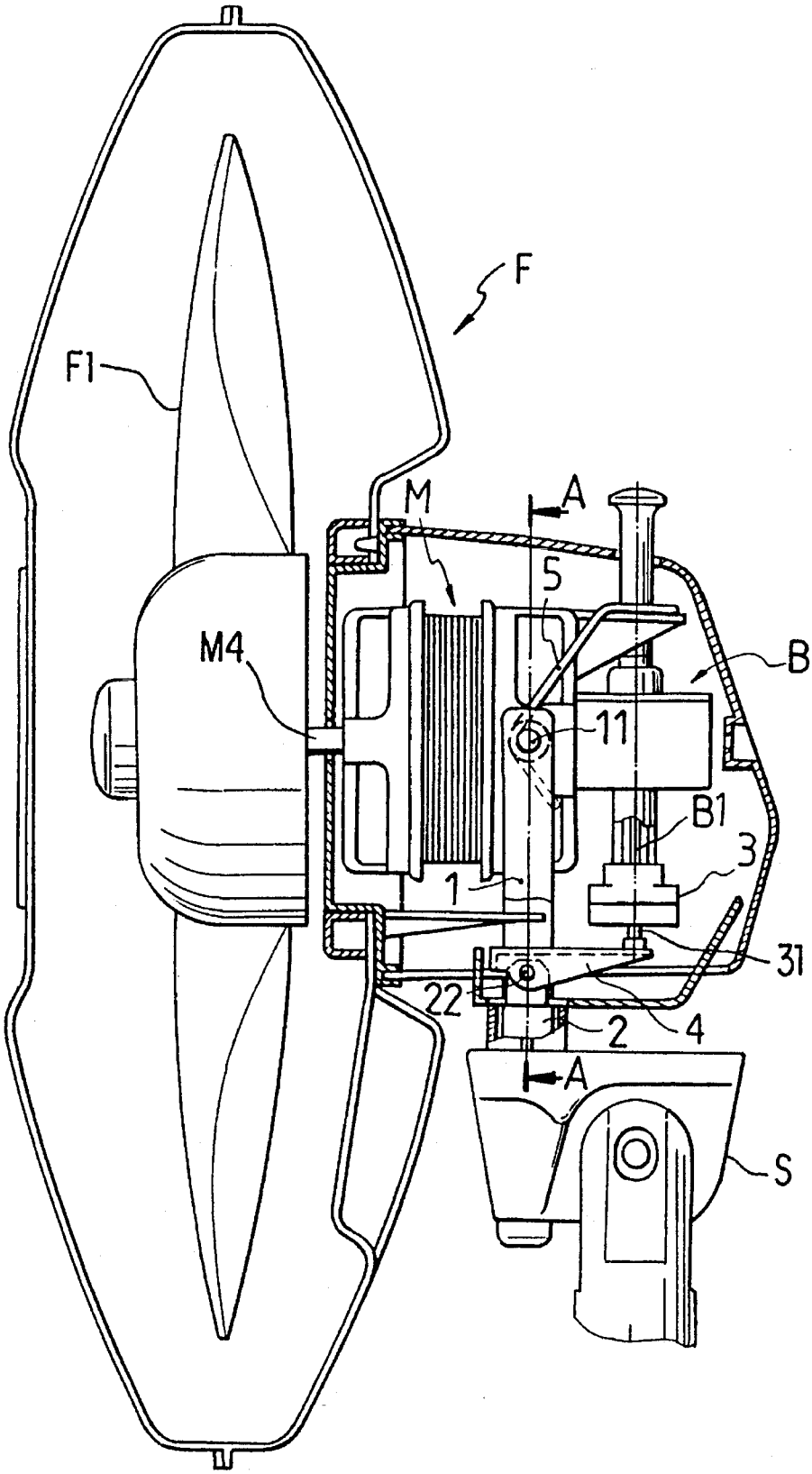
FIG. 3 is a partial cross-sectional side view of a fan of the present invention, depicting the fan motor and positioning mechanism in a configuration so as to direct the fan head horizontally and rightward.
Figure 4:
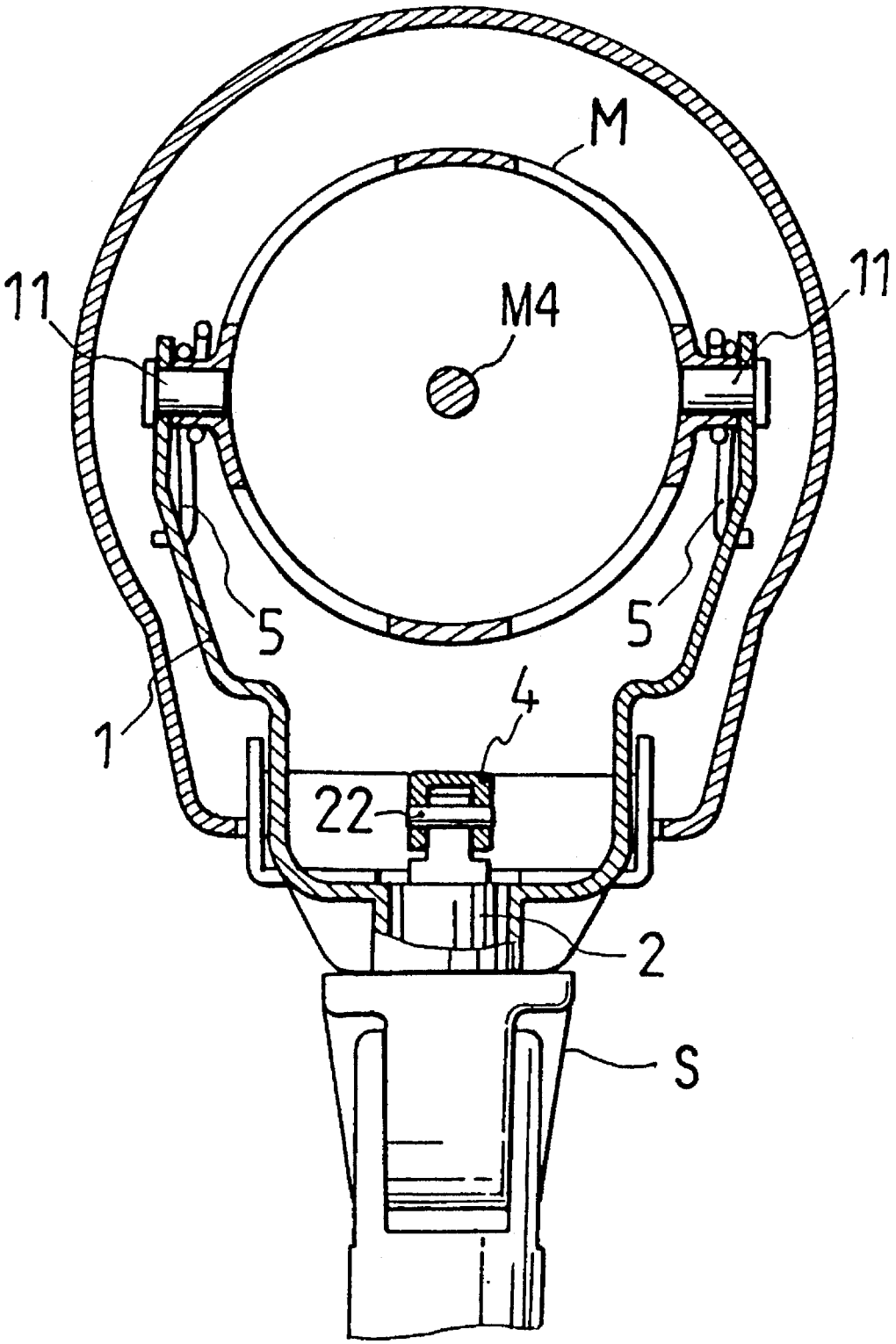
FIG. 4 is a rear cross-sectional view taken at plane A—A of FIG. 3, but depicting some components positioned normal to view for clarity.

In FIG. 3 a cross-sectional side view is taken through fan head (F), exposing the motor (M) and positioning mechanism. Rotating link (3) is directed back away from the observing view, forming a ninety degree angle with swinging link (4) when viewed from above (as in FIG. 5(A2)) so that ball & socket connection (31) is aimed back from gearbox shaft (B1) away from the observing view of FIG. 3. Gearbox shaft (B1) is approximately halfway between its closest and farthest positions from the vertical pin. In this position, vertical pin (2) is parallel with gearbox shaft (B1) and perpendicular to motor shaft (M4), and the fan head direction is thereby horizontal. Because the ball & socket connection is behind and not coplanar with the axes of the gearbox shaft and vertical pin, the fan head is not directed straight forward, but is instead directed rightward. Although fan head (F), motor (M), yoke (1), and gearbox (B) are depicted normal to view in FIG. 3 for clarity, the airstream from the fan during this position would actually be directed slightly away from view, as better illustrated in FIG. 5(A2) where a partial top view of those positioning components is provided. The same positioning of fan head (F) is represented in a partial rear view in FIG. 4, and a side view of only the positioning mechanism is provided in FIG. 5(A1).

Figure 5:
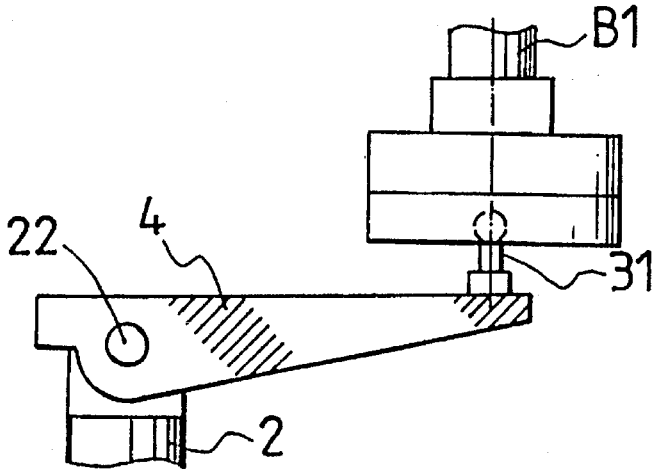
FIG. 5(A1) is a partial side view of the positioning mechanism of FIG. 3.
Figure 5:
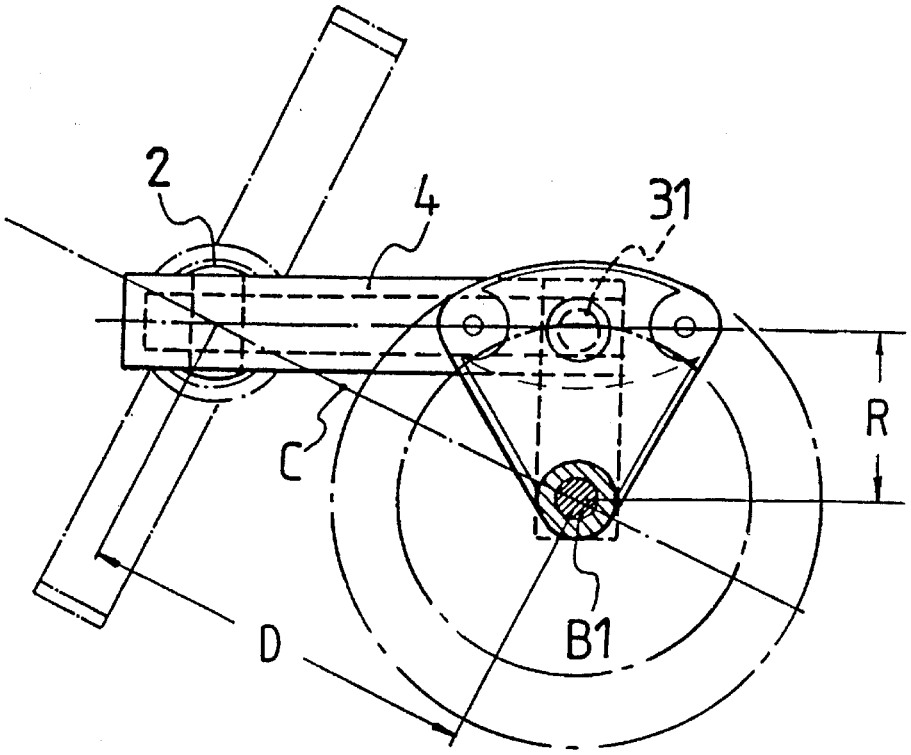
Figure 5:
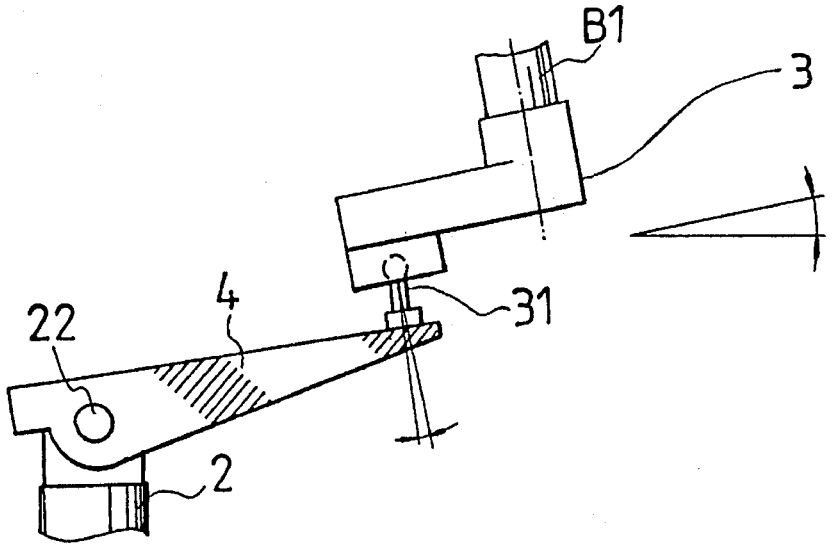
Figure 5:
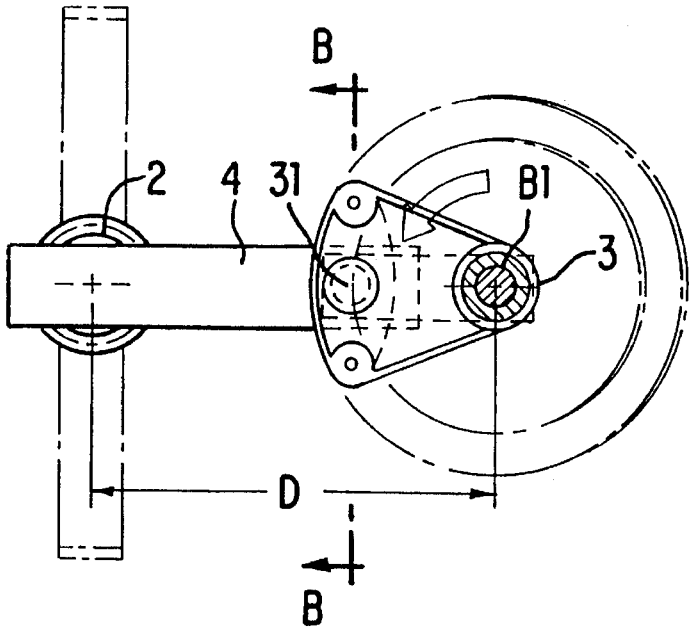
Figure 5:
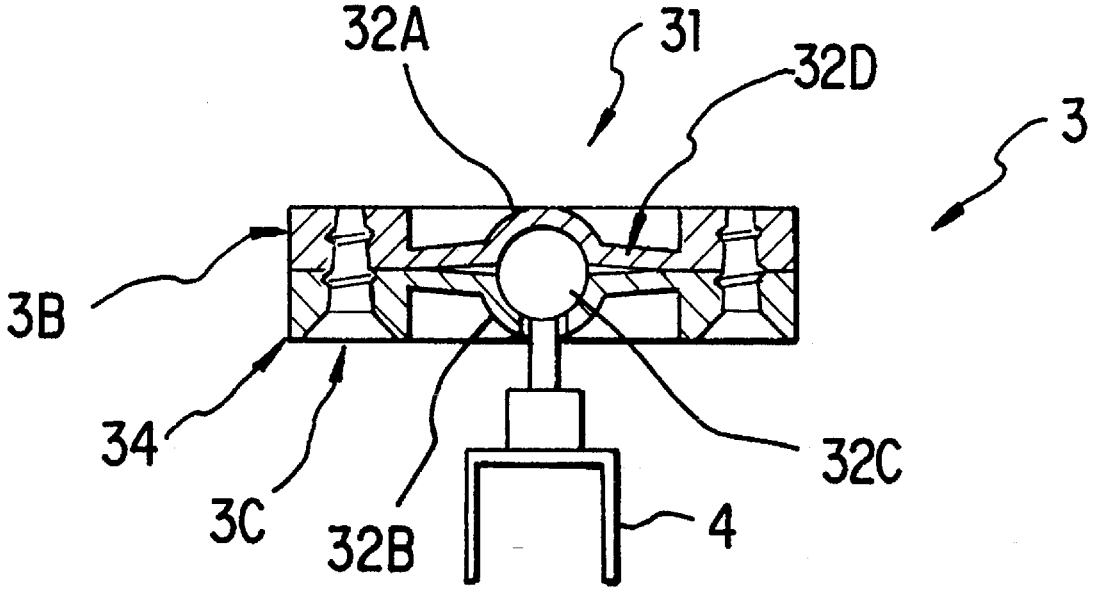
Figure 6:
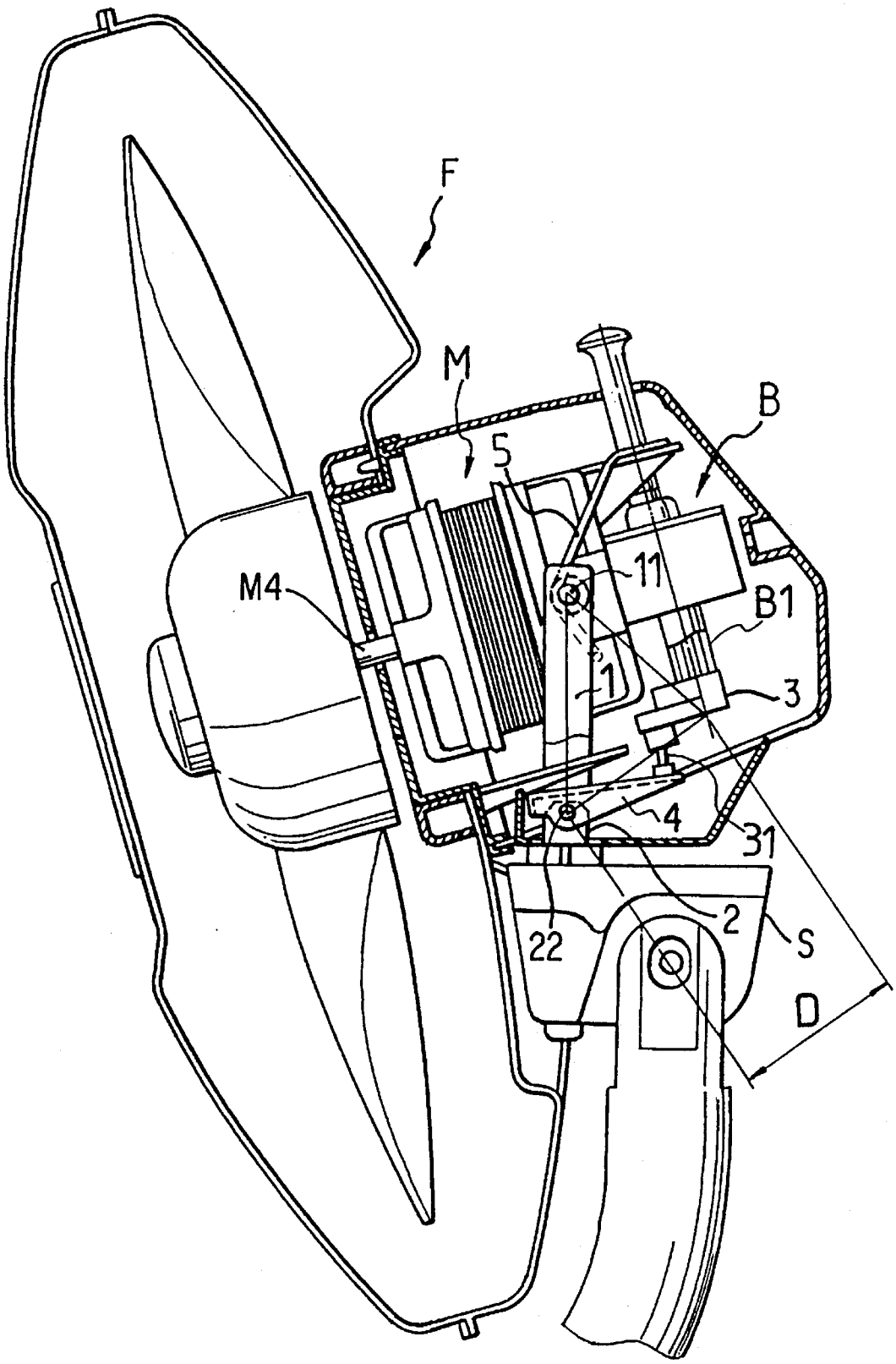
FIG. 6 is a partial cross-sectional side view of the fan of FIG. 3, but depicting the fan motor and positioning mechanism in a configuration so as to direct the fan head downward and forward.

In FIG. 6 a similar cross-sectional side view is taken through fan head (F), exposing the motor (M) and positioning mechanism. Rotating link (3) is now directed so that ball & socket connection (31) is aimed towards vertical pin (2) and gearbox shaft (B1) is at its farthest position from the vertical pin. The increased distance between the gearbox shaft and vertical pin force the fan head direction to lean downward. Because the ball & socket connection is coplanar with the axes of the gearbox shaft and vertical pin, the fan head is now directed straight forward. This is better illustrated in FIG. 5(B2), where a partial top view of those positioning components in this position is provided. The same positioning of fan head (F) is represented in a side view of only the positioning mechanism in FIG. 5(B1).

Figure 7:
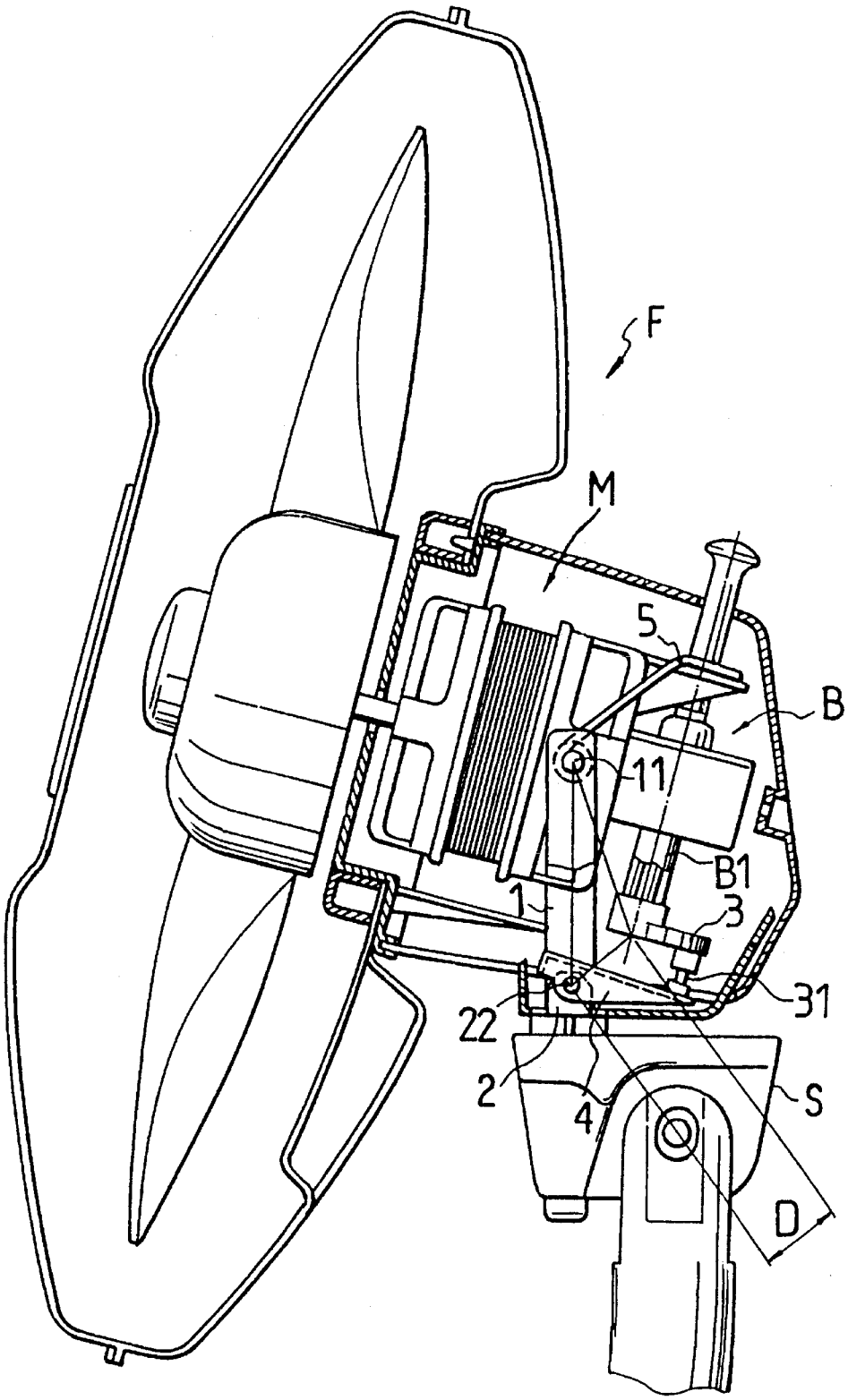
FIG. 7 is a partial cross-sectional side view of the fan of FIG. 3, but depicting the fan motor and positioning mechanism in a configuration so as to direct the fan head upward and forward.

In FIG. 7 a similar cross-sectional side view is taken through fan head (F), exposing the motor (M) and positioning mechanism. Rotating link (3) is now directed so that ball & socket connection (31) is aimed away from vertical pin (2) and gearbox shaft (B1) is at its closest position to the vertical pin. The decreased distance between the gearbox shaft and vertical pin force the fan head direction to lean upward. Because the ball & socket connection is again coplanar with the axes of the gearbox shaft and vertical pin, the fan head is again directed straight forward.

A cross sectional view of ball & socket connection 131 is provided in FIG. 5(B3), taken at plane B—B of FIG. 5(B2). Rotating link (3) includes crank portion (3B), clamp portion (3A), and screws (3C). Crank portion (3B) and clamp portion (3A) are molded plastic such as nylon or delryn, having both qualities of flexibility and low friction. Crank portion (3B) includes an upper socket half (32A) and clamp portion (3A) includes a lower socket half (32B) which, when the crank and clamp portions are attached together by the screws, capture the ball (32C) of swing arm (4) and form the socket of the ball & socket connection. The relatively frictionless qualities of the plastic socket provide a proper bearing surface against the ball. Prior to full engagement of the screws, a gap (32D) exists between the crank and clamp portions. As the screws become fully engaged, the gap is squeezed closed at the screws, and a clamping pressure is created at the ball & socket connection. This pressure is relatively light due to the flexible qualities of the plastic crank and clamp portions. This effectively provides a very low pressure spring-loaded clamping by the socket on the ball so that as the ball & socket connection wears over a period of use, a looseness will not form within the connection, which would otherwise result in sloppiness within the linkage of the positioning mechanism and an inconsistent motion of the fan head.

Figure 8:
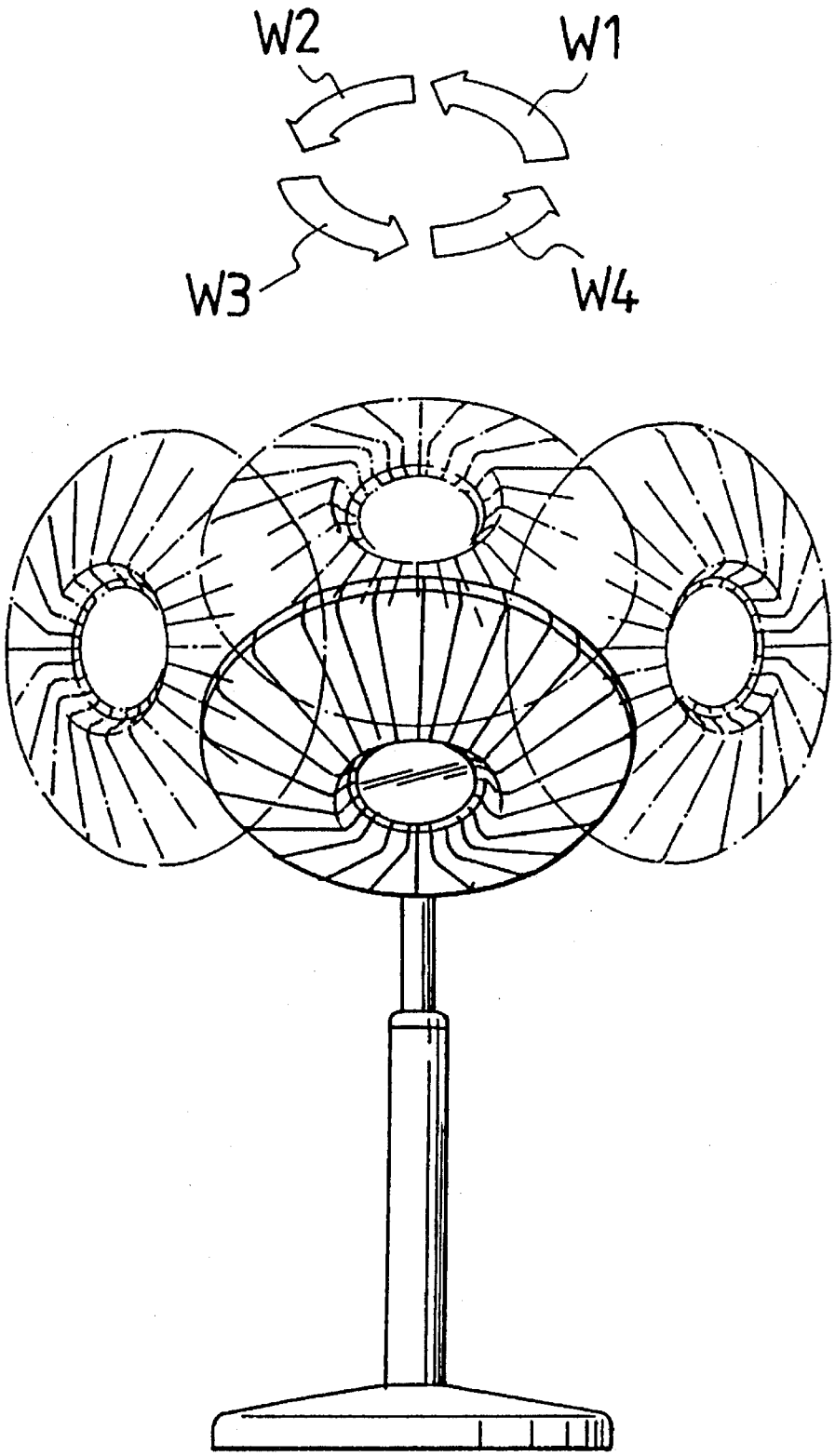
FIG. 8 is a front view of a fan of the present invention depicting various fan head positions.

A front view of the entire fan is provided in FIG. 8, wherein the fan head is directed downwardly in solid line representation, and in several other directions in phantom line representation. The ellipto-conical shape of the fan head redirection pattern can herein be more clearly seen.

It is also noted that alteration of various dimensional relationships of the mechanism's components will cause a change to the shape of the conical pattern which the fan head describes. The shape described by the airstream may be altered from a vertically oriented ellipto-cone to a horizontally oriented ellipto-cone, including also a circo-conical pattern. In the depicted embodiments, for instance, the axes of vertical pin (2), horizontally coaxial pivot pins (11), and horizontal swing pin (22) are coplanar. Separation of these axes will result in a change to the elliptical cross-section of the ellipto-conical pattern. If the horizontal swing pin is relocated forward (downstream) or rearward (upstream) of the plane which includes the axes of the vertical pin and the horizontally coaxial pivot pins while the lengths of rotating link (3) and swinging link (4) are altered accordingly, the cross-section of the fan head movement pattern would take various circular and elliptical shapes.

Another embodiment of the invention is depicted in FIGS. 10 through 13(B), to which reference is made throughout the remaining description.

In the depicted embodiment, fan motor (MM) is supported by yoke (101) at horizontally coaxial pivot pins (111). The head is free to pivot up-down about the horizontal axis of the pins. Tangential biasing springs (105), surrounding both horizontally coaxial pivot pins, act around the axis of the pins and between the yoke and the motor, forcing upward on the heavier forward (downstream) end of the motor, counter to the gravitational forces which bias the lighter rear (downstream) end of the motor upward. The bias springs thereby serve to bias the fan head (F) in a horizontally neutral position and reduce the stress on the positioning system as it alters the fan head's up and down position. The yoke is supported by and pivotably engages vertical pin (102), The yoke and the fan head are free to pivot side to side about the vertical axis of the vertical pin. The vertical pin is fixed within fan head support (SS), and restrained from rotation relative thereto.

The fan motor includes fan motor shaft (MM4), which engages and drives fan blade (FF1) at the downstream end, and which engages and drives reducing gears (not shown) at the upstream end within gear box (BB). The low-speed output shaft (BB1) of the gearbox rotates at a rotational speed slower than the fan motor rotational speed. The gearbox shaft is fixedly connected to rotating link (103), which in turn is connected eccentrically to swinging link (104) by ball & socket connection (131), so as to allow universal pivoting between the rotating and swinging links. Alternately, the swinging link is hingedly connected to the fan head support at horizontal swing pin (122) so as to allow unidirectional pivoting between the swinging link and the fan head support and limit the motion of the swinging link to only up and down. Because the distance between the ball & socket connection and the vertical pin is fixed by the rigidity of the swinging link, and, because the rotational position of the ball & socket connection about the vertical pin axis is fixed by the unidirectional pivoting of the swinging link, rotation of the rotating link through rotation of the fan motor shaft forces two simultaneous changes in the relationship between the gearbox shaft axis and the vertical pin. The distance between the two is sinusoidally increased and decreased while the rotational position of the gearbox axis about the vertical pin axis is sinusoidally altered. The sinusoidal altering of the rotational position of the gear box axis about the vertical pin axis causes the fan head, relative to which the gearbox axis is fixedly positioned, to pivot side to side about the pivotable engagement of the yoke and vertical pin. The sinusoidal increase and decrease in the distance between the gearbox shaft axis and the horizontal swing pin causes the fan head to pivot up and down about the horizontal coaxial pivot pins of the yoke. The simultaneous side-to-side and up-down oscillations result in the fan head direction changing continuously as it describes a conical shape.

Figure 9:
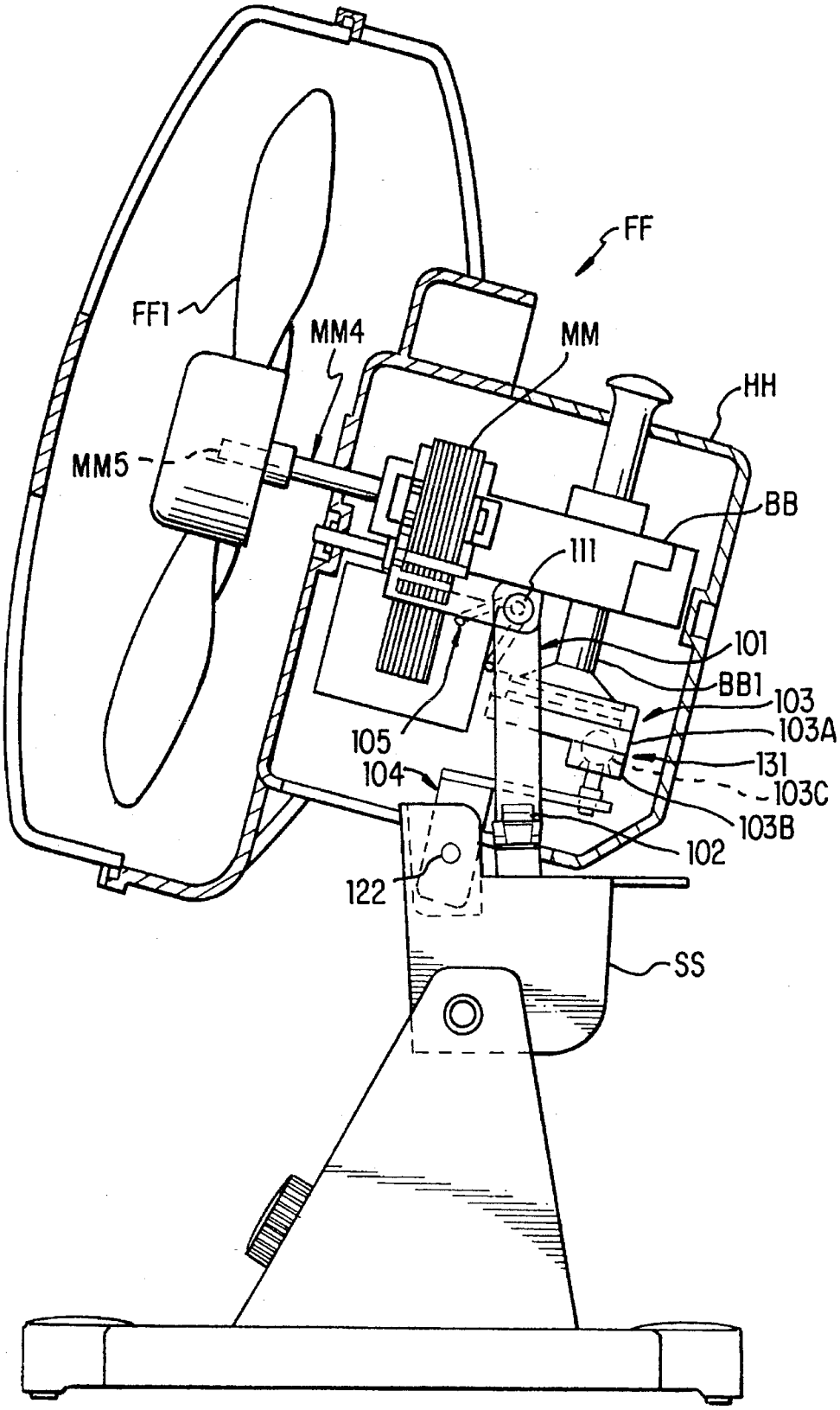
FIG. 9 is a cross-sectional side view of a fan of the present invention, depicting the fan motor and positioning mechanism in a configuration so as to direct the fan head upward.

In FIG. 9 a cross-sectional side view is taken through fan head (FF), exposing the motor (MM) and positioning mechanism. Rotating link (103) is directed so that ball & socket connection (131) is aimed away from vertical pin (102) and gearbox shaft (BB1) is at its closest position to the horizontal pin (122). The decreased distance between the gearbox shaft and horizontal swing pin force the fan head direction to lean upward. Because the ball & socket connection is coplanar with the axes of the gearbox shaft and vertical pin, the fan head is again directed straight forward. Although fan head (FF), motor (MM), yoke (101), and gearbox (BB) are depicted normal to view in FIG. 9 for clarity, the airstream from the fan during this position would actually be directed slightly away from view, as better illustrated in FIG. 12(B) where a partial top view of those positioning components is provided. The same positioning of fan head (FF) is represented in a side view of only the positioning mechanism in FIG. 12(A).

Figure 10:
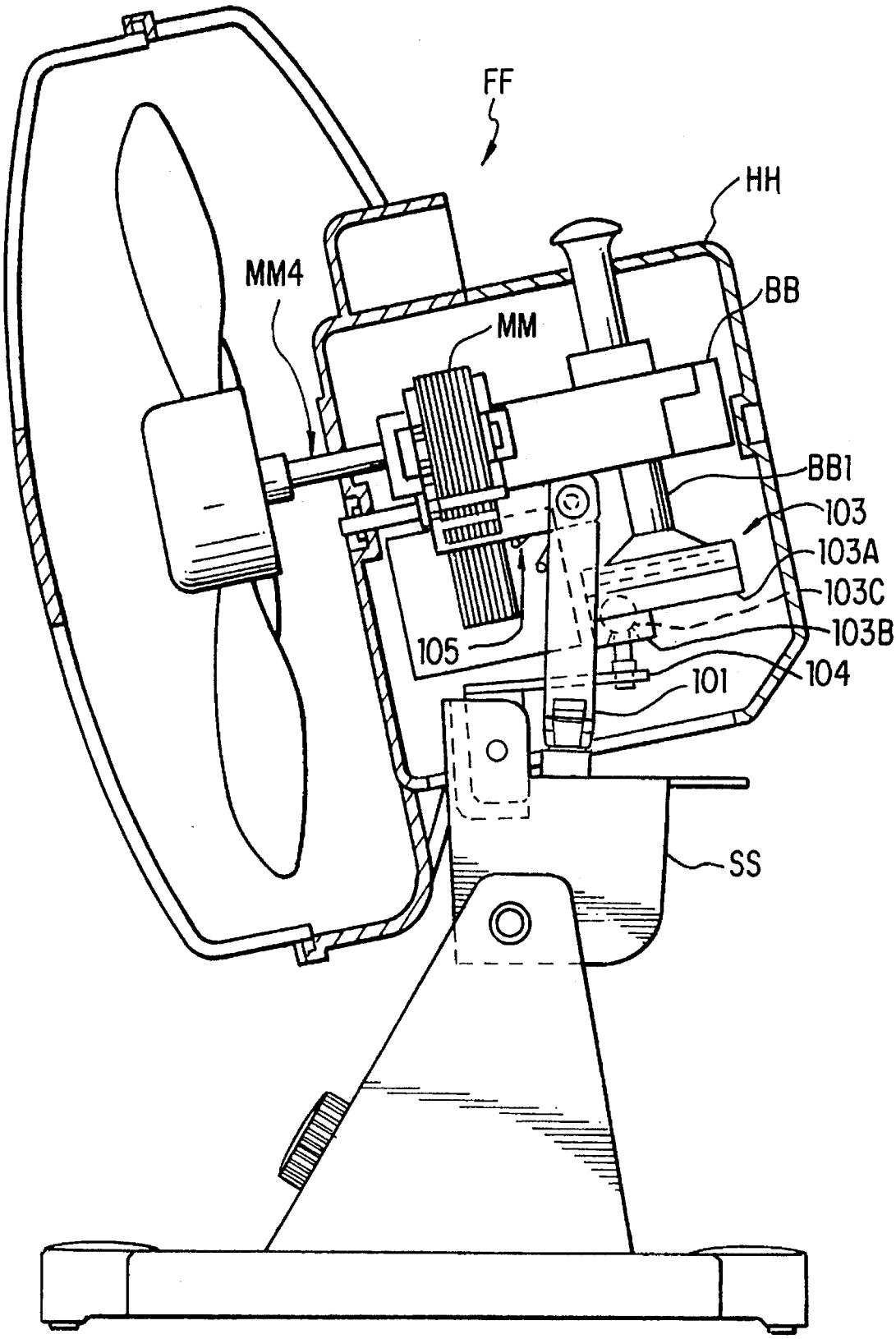
FIG. 10 is a cross-sectional side view of the fan of FIG. 9, depicting the fan motor and positioning mechanism in a configuration so as to direct the fan head downward.

In FIG. 10 a similar cross-sectional side view is taken through fan head (FF), exposing the motor (MM) and positioning mechanism. Rotating link (103) is now directed so that ball & socket connection (131) is aimed towards vertical pin (102) and gearbox shaft (BB1) is at its farthest position from the horizontal swing pin (122). The increased distance between the gearbox shaft and vertical pin force the fan head direction to lean downward. Because the ball & socket connection is coplanar with the axes of the gearbox shaft and vertical pin, the fan head is now directed straight forward.

Figure 11:
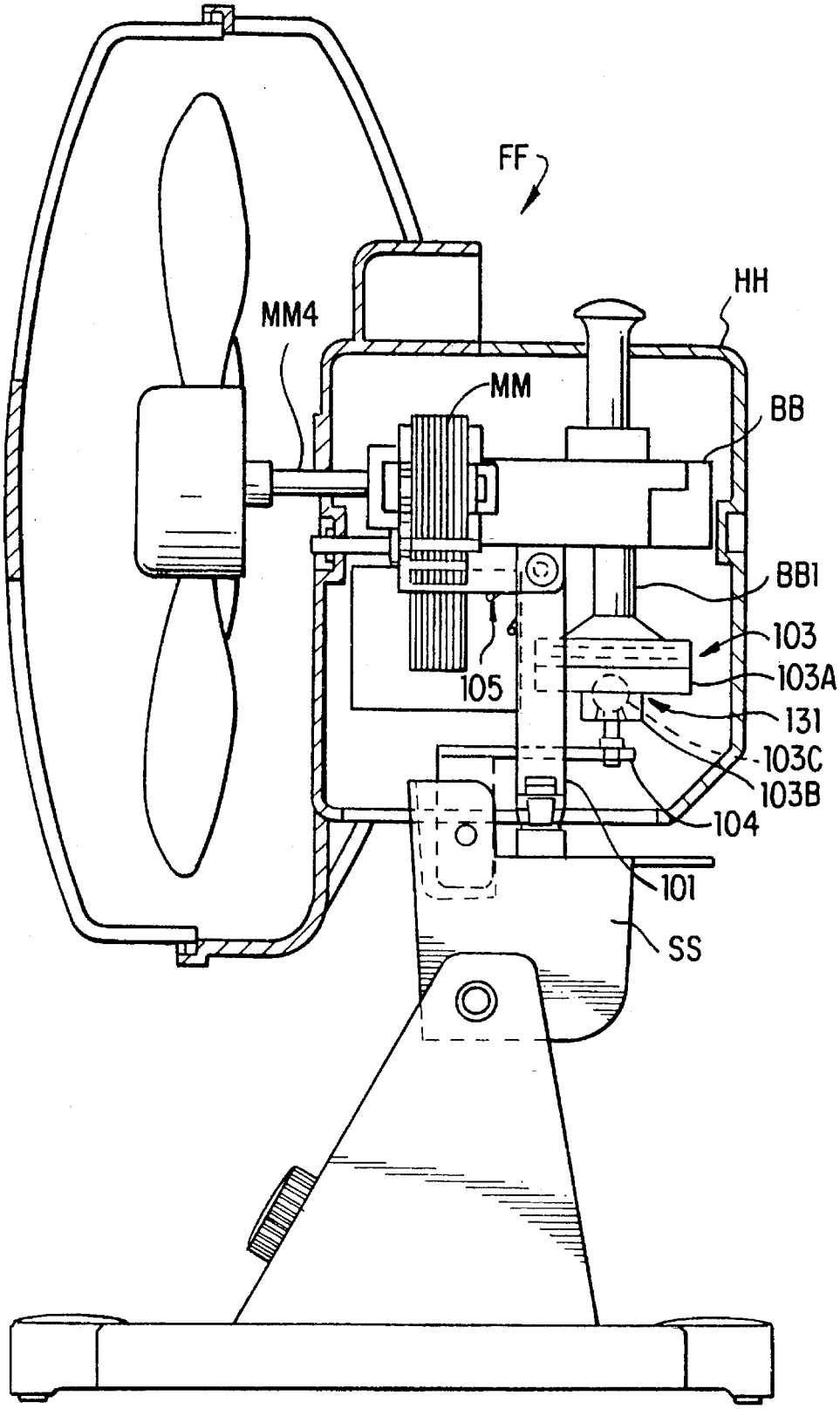
FIG. 11 is a cross-sectional side view of the fan of FIG. 9, depicting the fan motor and positioning mechanism in a configuration so as to direct the fan head rightward, but depicting some components positioned normal to view for clarity.
Figure 12A:
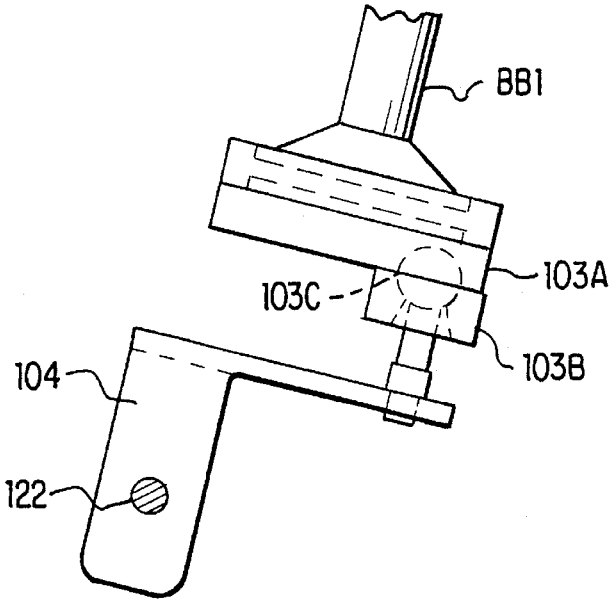
FIG. 12(A) is a partial side view of the positioning mechanism of FIG. 9.
Figure 12B:
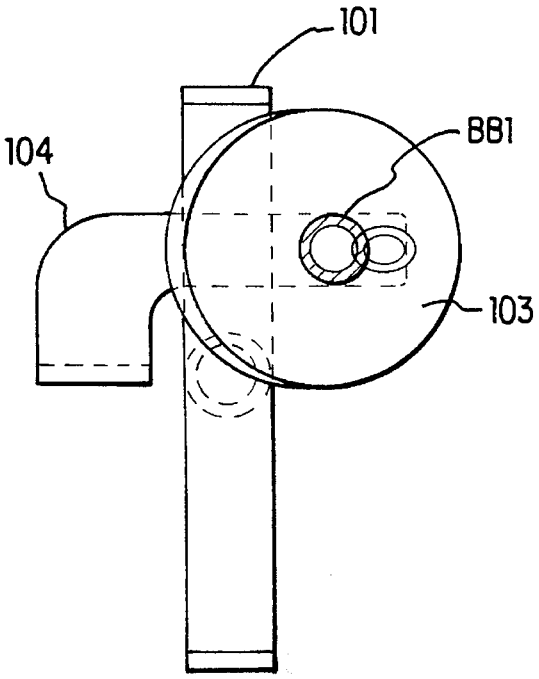
FIG. 12(B) is a top view of the positioning mechanism of FIG. 12(A)
Figure 13A:
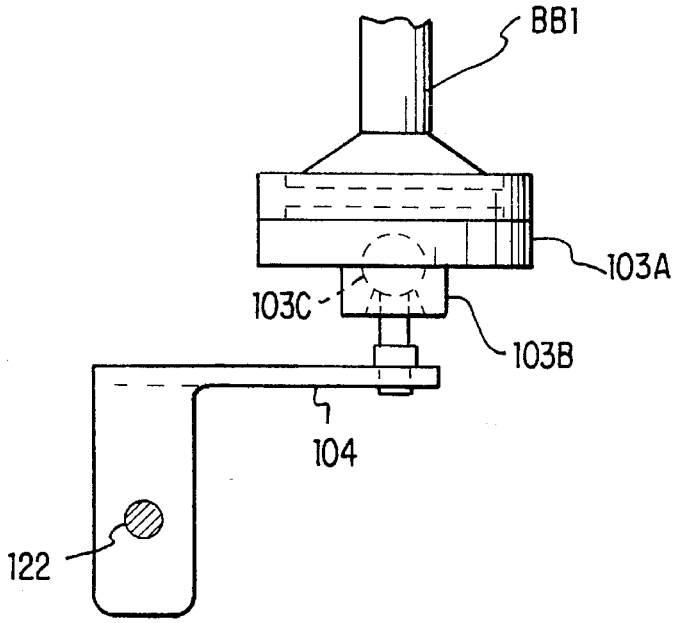
FIG. 13(A) is a partial side view of the positioning mechanism of FIG. 11.
Figure 13B:
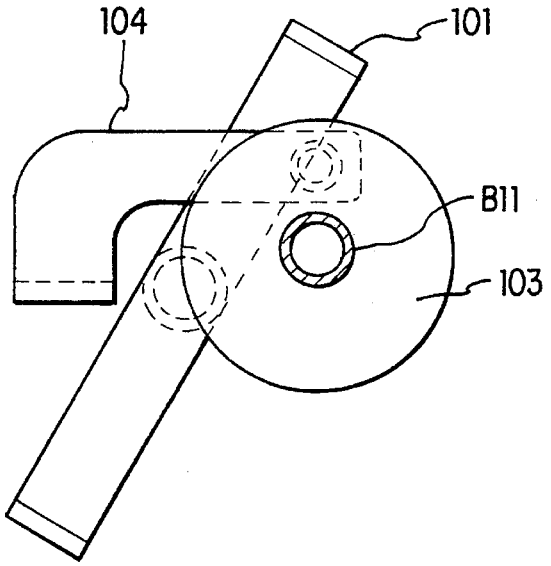
FIG. 13(B) is a top view of the positioning mechanism of FIG. 13(A).

In FIG. 11 a similar cross-sectional side view is taken through fan head (FF), exposing the motor (MM) and positioning mechanism. Rotating link (103) is directed back away from the observing view, forming a ninety degree angle with swinging link (104) when viewed from above (as in FIG. 13(B)) so that ball & socket connection (131) is aimed back from gearbox shaft (BB1) away from the observing view of FIG. 11. Gearbox shaft (BB1) is approximately halfway between its closest and farthest positions from the vertical pin. In this position, vertical pin (102) is parallel with gearbox shaft (BB1) and perpendicular to motor shaft (MM4), and the fan head direction is thereby horizontal. Because the ball & socket connection is behind and not coplanar with the axes of the gearbox shaft and vertical pin, the fan head is not directed straight forward, but is instead directed rightward. Although fan head (FF), motor (MM), yoke (101), and gearbox (BB) are depicted normal to view in FIG. 11 for clarity, the airstream from the fan during this position would actually be directed slightly away from view, as better illustrated in FIG. 13(B) where a partial top view of those positioning components is provided. The same positioning of fan head (FF) is represented in a side view of only the positioning mechanism in FIG. 13(A).

As earlier noted, alteration of various dimensional relationships of the mechanism's components will cause a change to the shape of the conical pattern which the fan head describes. Provided that the dimensional relationships of the vertical pin, horizontally coaxial pivot pins, gearbox axis, are respectively equal in the first embodiment to those in the second embodiment, and that the distance from the gearbox axis to the ball & socket connection is equal also, the shape described by the airstream of the second embodiment is a more vertically oriented ellipto-cone than that of the first embodiment, due to the positioning of the horizontal swing pin downstream of the vertical pin. This results from the increased angle through which the fan head is forced to pivot up & down.

Although particularly useful as herein embodied, it will be easily recognized by those skilled in this and related arts that this mechanism may be useful in other motorized appliances as well, wherever continuous repositioning within the appliance derived from the motor shaft rotation is beneficial. Hence the invention is not merely limited to use in electrical fans.

Further, although some specific features of the invention are shown in the drawings, other embodiments will occur to those skilled in the art and are within the following claims:

I claim:

1. An electrical fan having a fan head and a base portion, said fan head including;

a fan motor with a motor shaft rotationally coupled about a motor axis to a fan blade for providing an airstream therefrom, a swivel mechanism for controlling and limiting the relative positioning of said fan head and said base portion, including;

a support for connecting said fan head to said base portion in universally pivotable engagement and defining two or more pivot axes, a rotating link rotationally coupled to said fan motor and having an axis of rotation fixedly positioned relative to said fan head, a swinging link eccentrically connected to said rotating link and universally pivotable relative thereto, said swinging link further being plano-pivotably connected to said base portion at a swing axis not parallel to said rotating link axis, a biasing spring fixedly engaging said fan head during all fan head positions allowed by said swivel mechanism, to balance gravitational forces thereon about one or more of said pivot axes, whereby rotation of said motor shaft causes continuous and sinusoidal pivoting between said head and base portions simultaneously about said two or more pivot axes, thereby moving said fan head relative to said base portion and continuously redirecting said airstream in a substantially conical pattern.

2. The fan of claim 1 wherein said two or more pivot axes are a first pivot axis and a second pivot axis perpendicular thereto.

3. The fan of claim 2 wherein said support comprises a U-shaped yoke pivotably engaging said base about said first pivot axis and pivotably engaging said motor about said second pivot axis, and wherein said biasing spring acts between said motor and yoke around said second pivot axis, and is pivotable about said first pivot axis with said yoke and said motor.

4. The fan of claim 3 wherein said swing axis is parallel to said second pivot axis and to a plane containing said eccentric connection, and said swinging link is plano-pivotable on a plane parallel to said first pivot axis.

5. The fan of claim 4 wherein said swinging link is plano-pivotable on a plane parallel to and containing said first pivot axis.

6. The fan of claim 2 wherein said first and second pivot axes lie on a plane and said swing axis is parallel thereto.

7. The fan of claim 6 wherein said first and said second pivot axes and said swing axis are coplanar.

8. The fan of claim 1 wherein one of said rotating or swinging links includes a spherical connection portion, and said other link comprises first and second socket portions capturing said spherical connection portion to thereby form said eccentric connection of said rotating and swinging links.

9. The fan of claim 8 wherein said first socket portion is integrally formed in said other link.

10. The fan of claim 9 wherein said other link is molded plastic and said first socket portion is integrally molded therein.

11. The fan of claim 8 wherein said first and second socket portions capture said spherical connection portion in spring-loaded engagement to minimize connection looseness.

12. The fan of claim 1 wherein said substantially conical pattern is ellipto-conical.

13. An electrical fan comprising;

a moving fan head including a rotating fan motor with a fan blade rotatably coupled thereto for providing an airstream therefrom, a stationary base, and a swivel mechanism connecting and limiting said fan head and said base, for controlling the position of said fan head relative to said base and including;

a fan head support pivotably engaging said base about a first pivot axis and pivotably engaging said fan head about a second pivot axis perpendicular to said first pivot axis to allow universal pivoting of said fan head relative to said base, a biasing spring fixedly engaging said fan head during all fan head positions allowed by said swivel mechanism to balance gravitational forces thereon about one or both of said pivot axes, a rotating link coupled to said rotating motor by a speed reducing mechanism, and having a rotating link axis fixedly positioned relative to said fan head, said rotating link having a first socket portion integrally formed therein at a distance from said rotating link axis, and having a second socket portion attached to said first socket portion to thereby form a connection socket, a swinging link including a spherical connection portion captured by said connection socket and thereby connected to said rotating link and universally pivotable relative thereto, said swinging link further being connected to said base at a swing axis not parallel to said rotating link axis, and said swinging link further being plano-pivotable relative to said base about said swing axis, and whereby rotation of said motor causes continuous and sinusoidal pivoting of said fan head simultaneously about said first and second pivot axes, thereby moving said fan head relative to said base to continuously redirect said airstream in a substantially conical pattern.

14. The fan of claim 13 wherein said first and second socket portion are plastic.

15. The fan of claim 14 wherein said support comprises a U-shaped yoke, and said biasing spring acts between said motor and yoke around said second pivot axis, and is pivotable about said first pivot axis with said yoke and said motor.

16. The fan of claim 15 wherein said first and second socket portions capture said spherical connection portion in spring-loaded engagement to minimize connection looseness.

17. The fan of claim 16 wherein said swing axis is parallel to a plane containing said first and second pivot axes, is parallel to a plane containing said eccentric connection, is perpendicular to one of said first or second pivot axes and said rotating link axis, and is parallel to the other of said first or second pivot axes.

18. The fan of claim 17 wherein said swing axis lies on said plane containing said first and second pivot axes

19. The fan of claim 13 wherein said substantially conical pattern is ellipto-conical.

20. A method of continuously redirecting an airstream from an electrical fan in a continuous conical pattern, said electrical fan including;

a fan head including a rotatable fan motor with a fan blade rotatably coupled thereto for providing said airstream therefrom, a stationary base, and a swivel mechanism connecting and limiting said fan head and said base, for controlling the position of said fan head relative to said base and including;

a fan head support pivotably engaging said base at a first pivot axis and pivotably engaging said fan head at a second pivot axis perpendicular to said first pivot axis to allow universal pivoting of said fan head relative to said base, a biasing spring fixedly engaging said fan head during all fan head positions allowed by said swivel mechanism, to balance gravitational forces thereon about one or both of said pivot axes, a rotatable link coupled to said rotatable motor by a speed reducing mechanism and having a rotatable link axis fixedly positioned relative to said fan head, a swingable link eccentrically connected to said rotatable link and universally pivotable relative thereto, said swingable link further being connected to said base at a swing axis not parallel to said rotatable link axis, and said swingable link further being plano-pivotable relative to said base about said swing axis, said method comprising;

rotating said motor to thereby rotate said fan blade and provide said airstream and to also thereby simultaneously rotate said rotatable link about said rotatable link axis, thereby planarly swinging said swingable link at said eccentric connection about said swing axis, to thereby force said fan head to simultaneously pivot continuously and sinusoidally about said first and second pivot axes, thereby continuously moving said fan head relative to said base in said substantially conical pattern.

* * * * *